US009290364B2

(12) United States Patent
Willim

(10) Patent No.: US 9,290,364 B2
(45) Date of Patent: Mar. 22, 2016

(54) CRANE

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 842 days.

(21) Appl. No.: 12/899,889

(22) Filed: Oct. 7, 2010

(65) Prior Publication Data

US 2011/0084043 A1 Apr. 14, 2011

(30) Foreign Application Priority Data

Oct. 9, 2009 (DE) ..... 10 2009 048 846

(51) Int. Cl.
*B66C 23/82* (2006.01)

(52) U.S. Cl.
CPC ..... *B66C 23/82* (2013.01)

(58) Field of Classification Search
CPC .... B66C 23/82; B66C 23/821; B66C 23/826; B66C 23/828; B66C 23/825
USPC ..... 212/262, 260, 239, 237, 175
See application file for complete search history.

(56) References Cited

U.S. PATENT DOCUMENTS

| | | | | |
|---|---|---|---|---|
| 2,042,460 | A * | 6/1936 | Fykse | 37/396 |
| 3,219,197 | A * | 11/1965 | Eskil | 212/310 |
| 6,508,372 | B1 * | 1/2003 | Lamphen et al. | 212/279 |
| 6,550,624 | B1 * | 4/2003 | Irsh et al. | 212/299 |
| 2002/0070187 | A1 * | 6/2002 | Willim | 212/299 |
| 2006/0016775 | A1 * | 1/2006 | Willim | 212/347 |
| 2008/0023432 | A1 * | 1/2008 | Paschke | 212/298 |

FOREIGN PATENT DOCUMENTS

| | | | |
|---|---|---|---|
| CN | 101638207 | A | 2/2010 |
| DE | 3113763 | | 10/1982 |
| DE | 3838975 | | 5/1990 |
| DE | 20002748 | | 8/2000 |
| DE | 10022600 | | 7/2001 |
| DE | 202005003207 | | 7/2006 |
| DE | 202005009317 | | 10/2006 |
| DE | 202008009281 | * | 11/2009 |
| DE | 202008009281 | | 12/2009 |
| EP | 1466855 | | 10/2004 |
| EP | 2067737 | | 6/2009 |

(Continued)

OTHER PUBLICATIONS

English Translation of DE 202008009281 U1.*

(Continued)

*Primary Examiner* — Sang Kim
*Assistant Examiner* — Nathaniel Adams
(74) *Attorney, Agent, or Firm* — Dilworth & Barrese, LLP.

(57) ABSTRACT

The within invention relates to a crane with a boom slewable in a vertical pivoting plane and a bracing boom arrangement, particularly a derrick boom arrangement in which a luffing cable is arranged between the boom and the bracing boom arrangement, in which the luffing cable has at least two guying cables that run from two guying points arranged on the opposite side of the pivoting plane, which cables belong to the bracing cable arrangement, to the boom, in which the two guying cables are each movable by means of a winch and in which a mechanical coupling is provided between the two winches by means of which the movement of the two winches can be force coupled.

21 Claims, 5 Drawing Sheets

(56) References Cited

FOREIGN PATENT DOCUMENTS

| | | | |
|---|---|---|---|
| JP | 9-136789 | A | 5/1997 |
| JP | 2006-273530 | | 10/2006 |

OTHER PUBLICATIONS

Chinese First Office Action for Application No. 201010505465.4 dated Dec. 3, 2013.

* cited by examiner

CRANE

BACKGROUND OF THE INVENTION

The within invention relates to a crane with a superstructure to which a boom is hinged in a luffable manner in a vertical pivoting plane, and a bracing boom arrangement hinged to the superstructure, particularly a derrick boom arrangement, wherein a cable is provided between the boom and the bracing boom arrangement, and wherein the cable has at least two guying cables that run to the boom on two guying points of the derrick boom arrangement located on opposite sides of the pivoting plane.

Such spatial guying of the boom has the advantage that it supports the boom even against forces acting perpendicular to the pivoting plane.

Such a crane is known from DE 20 2005 009 317 U1. Here, two boom supports are provided that are each hinged to the superstructure in a pivotable manner around an inclined swiveling axle. In one of the positions rotated toward the front, the two boom supports permit good spatial guying of the boom. In its position extended toward the rear, the two boom supports can be used as derrick booms. The spatial guying here, however, is considerably poorer than in the position rotated toward the front.

A clamping system for a telescoping crane is known from EP 1 466 855 A2 in which guying cables are guided over two guying supports that can be pivoted in relation to the superstructure. However, this solution does not facilitate the optimal spatial guying.

SUMMARY OF THE INVENTION

The within invention therefore relates to enabling an improved spatial guying of a boom.

This task is solved, according to the invention, by a crane herein. The crane according to the invention has a superstructure to which a boom is hinged in a luffable manner in a vertical pivoting plane. In addition, a bracing boom arrangement, particularly a derrick boom arrangement, is hinged with the superstructure. Here, cabling is provided between the boom and the bracing boom arrangement, wherein the cabling has at least two guying cables that run to the boom over two guying points of the bracing boom arrangement on opposite sides of the pivoting plane. According to the invention, provision is made for the bracing boom arrangement to be pivotable around a luffing axle standing perpendicular to the pivoting plane of the boom and a cross-connection between the two guying points.

The luffing axle standing perpendicular to the pivoting plane of the boom ensures that the two guying points are always at the same distance from each other, regardless of the pivot position of the bracing boom arrangement. The bracing boom arrangement according to the invention thus facilitates good spatial guying, regardless of the pivot angle of the bracing boom arrangement. The cross-connection between the two guying points picks up the forces occurring during guying and thus permits a substantially more stable design of the bracing boom arrangement. The cross-connection thus pivots with the bracing boom arrangement. In particular, the cross-connection can be equipped such that it picks up the compressive loads and/or tensile loads. In particular, the cross-connection here can be a connection, rigid in terms of moment, between the two guying points in any desired form.

The guying points of the bracing boom arrangement are advantageously at a distance from each other that is greater than the width of the boom. In particular, the guying points here are at a distance that is advantageously more than twice, and more advantageously more than four times as much as the width of the boom. Further advantageously, the guying points of the bracing boom arrangement are at a distance from each other that is greater than the width of the superstructure and/or the supporting surfaces of the crane.

The superstructure of the crane according to the invention advantageously slews around a vertical slewing axis. Further advantageously, the superstructure is arranged in a slewable manner on a mobile undercarriage. In particular, the crane according to the invention can be a mobile crane or a crawler crane.

The distance between the guying points is advantageously more than the width of the superstructure and/or more than the width of the undercarriage. The crane, further advantageously, has a guying arrangement by which it can be braced on the ground. In particular, this can involve the traveling gear of the undercarriage. The distance between the two guying points here is advantageously greater than the width of the supporting surfaces of the crane.

Further advantageously, the guying cables run at an angle from the two guying points inward to the boom, so that they form an isosceles triangle with the connecting line of the guying points on the ground side, the point of which triangle ends at the boom. The guying points here are advantageously arranged symmetrically in relation to the pivoting plane.

Further advantageously, the bracing boom arrangement forms a rigid structural unit that is hinged to a pivoting axle on the superstructure, while axle stands perpendicular to the pivoting plane of the boom. Such a rigid structural unit thus facilitates optimal stability of the guying and synchronization of the guying points when the bracing boom arrangement is luffing. The bracing boom arrangement here is advantageously hinged to the superstructure by means of an articulation component.

The bracing boom arrangement advantageously comprises two V-shaped derrick boom supports arranged on an articulation component that are connected by means of at least one and advantageously at least two cross-members, perpendicular to the pivoting plane. In particular, a cross-member is provided here that connects the two tips of the boom supports together. Further advantageously, another cross-member is provided that, in the area between the articulation component and the tips of the boom tops, connects them together.

The cable according to the invention advantageously is a cable that is variable in length. One or more winches are advantageously provided for this purpose. In particular, this involves lulling cables by which the boom can be pivoted upward and downward.

Further advantageously, provision is made for one or more winches to be arranged for the actuation of the guying cables on the bracing boom arrangement. This facilitates optimal changing of the length of the guying cables by means of the winch(es). The winch(es) here can, for example, be arranged on a cross-member of the boom arrangement. The cables here can run from the winches to the guying points via return pulleys.

The guying cables on the two guying points are mounted by means of cardan joints to the bracing boom arrangement, particularly by means of the return pulleys that are hinged in a slewable manner at two axles to the bracing boom arrangement. In luffing operation of the boom, the angle of the guying cables between the bracing boom arrangement and the boom change constantly. The cardan mount of the guying cables thus permits good guidance of the buying cables, even during luffing operations.

Provision is advantageously made for the two guying cables to each be movable by means of a winch. When necessary, the two guying cables can thus be moved separately from each other.

It is advantageous here to provide a mechanical coupling between the two winches by means of which the two winches can be moved in forced coupling. This facilitates sure synchronization of the two winches so that they are evenly loaded when the boom is luffing and are thus held in the pivoting plane.

Further advantageously, the crane comprises a cable length detector to detect and monitor the length of the two guying cables. This can ensure that the boom is not accidentally loaded more heavily by one of the two guying cables and thus pulled out of the pivoting plane. Such a cable length detection is also advantageous when the two winches are force coupled by means of a mechanical coupling. In this case as well, for example, a discrepancy can arise when changing position or in case of unreeling errors when winching in the cables. These differences are now detected by means of the cable length detection.

The crane controls advantageously even off the length of the two guying cables based on the data from the cable length detector. The controls trigger a reaction in case of impermissible deviation; in particular, the controls issue a warning in this case. Alternatively or additionally, the controls can also intervene in the actuation of the drives. In particular, provision can be made for the controls to stop the drives.

Further advantageously, the crane controls and/or the cable length detector comprise(s) a zero-point function by means of which the deviation between the cable lengths can be set to zero at the start of operation of the crane. After rigging the crane and aligning the boom in the pivoting plane, the controls or cable length detector can be informed that the deviation between the cable lengths is equal to zero or that the boom is in the pivoting plane. Here, the deviation can be set to zero or the cable lengths can be set at an identical value. The cable length detector or the crane controls now measures any deviations from the zero point during the subsequent operation.

The cable length detector advantageously comprises a measurement system that measures the actual cable lengths wound off by the winches. In particular, the measurement system here is advantageously not based or not based only on the angle of rotation of the winches. Otherwise, for example, differences in length occurring when changing position or in case of unreeling errors might not be detected. The cable length detection can, for example, be handled by means of a metering roller placed in the path of the cable.

In the case of the bracing boom arrangement according to the invention, this advantageously involves a derrick boom arrangement to which a derrick ballast is attached. Such a derrick ballast component can be attached, for example, by means of a cable on the bracing boom arrangement. The derrick ballast here lies on the ground and can be hoisted by means of a power hoist. A hydraulic cylinder can be used, for example, as the power hoist.

The derrick ballast balances out the moment acting through the load on the boom and (by means of the cables) on the bracing boom arrangement. The distance of the derrick ballast and thus the lever action can be changed through the up and down luffing of the bracing boom arrangement.

The derrick ballast is thus advantageously arranged outside the support surfaces of the crane. In particular, the slew circle of the derrick ballast is advantageously located outside the support surfaces of the crane so that the superstructure with the appended derrick ballast can be slewed with regard to the undercarriage.

The bracing boom arrangement advantageously comprises at least two separate derrick ballast components that are attached at least two separated attachment points on the bracing boom arrangement. An improved lateral guying of the boom is facilitated by the two separated attachment points at which a derrick ballast component is attached, so that the high lateral forces occurring with heavy lifts and a rigid boom can be handled better by means of the guying device. In addition, the two separated derrick ballast components enable easier travel of the crane and/or stewing of the superstructure with the attached derrick ballast components since, with the division of the derrick ballast into at least two separate derrick ballast components, they no longer need to be arranged in the pivoting plane of the boom. The derrick ballast components can thus be positioned such that improved travel and/or stewing is procured with simultaneously increased lateral stability of the boom. The distance between the two guying points advantageously corresponds essentially to the distance between the articulation points of the two derrick ballast components.

The derrick ballast components (and, accordingly, the attachment points for the derrick ballast components) are thus advantageously arranged or can be arranged to the side of the undercarriage and/or the superstructure. In particular, the derrick ballast components (and, accordingly, the attachment points for the derrick ballast components) are thus advantageously arranged or can be arranged to the side of the support surfaces of the crane. Thus, the center of gravity of the boom arrangement even without the attached load lies within the support surfaces so that the crane can travel or slew with the attached derrick ballast components. The two derrick ballast components (and accordingly the attachment points for the derrick ballast components) are thus arranged on the opposite side with regard to the pivoting plane of the boom. Unlike in the current art, the distance of the derrick ballast from the slew axis of the superstructure is no longer limited toward the front by the length of the superstructure, due to the lateral arrangement of the two derrick ballast components according to the invention. In addition, such an arrangement is connected with safe lateral guying of the boom with the advantages of derrick guying.

The attachment points are arranged or can be arranged near the undercarriage so that the crane can travel with the derrick ballast components hung on the attachment points. In particular, the derrick ballast components for this must be arranged or can be arranged near the traveling gear of the undercarriage. Further advantageously, the attachment points are arranged or can be arranged outside the slewing circle of the undercarriage or the superstructure so that the superstructure can be turned with the derrick ballast components hung at the attachment points.

Furthermore the separation of the connecting line of the two attachment points to the slewing axis of the superstructure can be changed by pivoting the derrick boom arrangement. The lever action of the derrick ballast, which is dependent on this separation, can be changed thereby, and the load applied on the crane by the derrick ballast can be adjusted to the load attached to the crane. In particular, it is also possible here to position the common center of gravity of the two derrick ballast components so near to the slew axis of the superstructure that the center of gravity of the crane is positioned within the footprint of the crane, even without the attached load. Changing the distance of the connecting line of the two attachment points to the slew axis of the superstructure is facilitated by the lateral arrangement of the derrick ballast components that are moved backward or forward on the two sides of the superstructure. The travel of the crane and/or slewing of the superstructure with attached derrick ballast components is facilitated hereby, even without a load as a counterweight.

The attachment points are arranged or can be arranged advantageously so that the travel and/or slew of the crane is available for different distances of the connecting line of the two attachment points to the slew axis of the superstructure. Here, the travel and/or slew is advantageously provided in a first position of the attachment points in which the distance of the connecting line to the slew axis is minimal and is essentially advantageously zero, and in a second position of the attachment points in which the distance of the connecting line to the slew axis is maximal. Further advantageously, the travel and/or slew is provided over the entire adjusting range of the derrick ballast components.

The attachment points according to the invention are advantageously arranged or can be arranged on both sides of the pivoting plane of the beam so that their connecting line is perpendicular to the pivoting plane. This enables symmetrical guying with a uniform load on the crane. The distance between the two attachment points is advantageously greater than the width of the undercarriage and/or the size of the support surface so that the travel of the crane and/or the slew of the superstructure with attached derrick ballast components is guaranteed.

Further advantageously, power hoists are provided that can hoist the derrick ballast components. The derrick ballast components can be hoisted by means of these power hoists so that the crane can travel or slew with the derrick ballast components hanging. Here, the derrick ballast components are kept very near to the ground.

The bracing boom arrangement can be luffed advantageously with regard to the superstructure by means of a cable. In particular, provision is advantageously made so that the lulling cables between the boom and the bracing boom arrangement and the cable for moving the bracing boom arrangement can be actuated separately. The bracing boom arrangement can be lulled advantageously by means of an SA block.

Provision is advantageously made so that the boom and/or the bracing boom arrangement is constructed of lattice units. In particular, the boom has an articulation component and a head member, between which a number of lattice units are arranged. The distance between the guying points in the bracing boom arrangement is advantageously larger than the width of the lattice units of the boom, particularly more than twice as wide and further advantageously more than four times as wide. The bracing boom arrangement further advantageously has an articulation component on which one or more lattice units are arranged.

The within invention further comprises a process for operating a crane as presented above. The process according to the invention provides that the boom is lulled in the pivoting place by means of the cables. In particular, the length of the two guying cables is changed by means of one or more winch(es) for this purpose.

Provision is advantageously made for the difference between the cable lengths to be set to zero at the start of crane operations. A position can thus be defined in which the boom is located in the pivoting plane. Differences between the cable lengths that occur during operation can thus be monitored.

BRIEF DESCRIPTION OF THE DRAWINGS

The within invention is now discussed in greater detail based on an embodiment and drawings. The drawings show.

DESCRIPTION OF THE PREFERRED EMBODIMENTS

Figure 1:
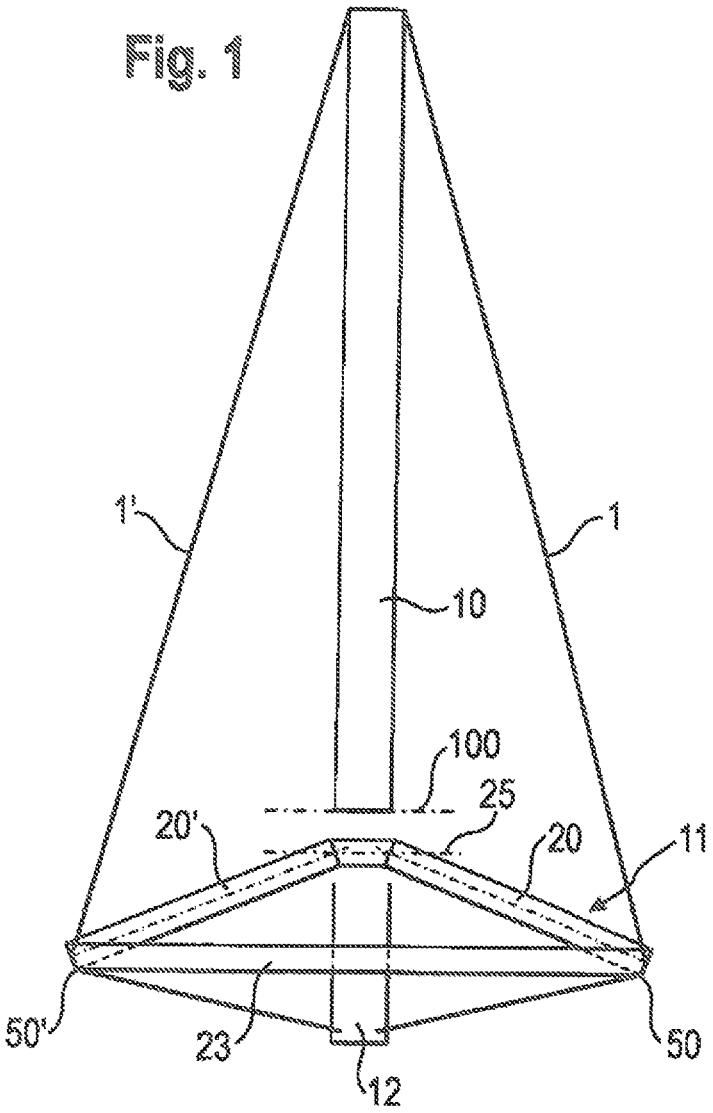
FIG. 1: A first embodiment of a crane according to the invention in a top view.

FIG. 1 shows an embodiment of the crane according to the invention in a top view. Here, boom 10 is provided that is hinged to the superstructure and can pivot around axis 100. Furthermore, a bracing boom arrangement 11 is provided that is also hinged to the superstructure. The boom 10 can be designed as a lattice boom.

The superstructure itself is not shown in greater detail in FIG. 1. The superstructure here is arranged on an undercarriage, also not shown. A traveling gear for the travel of the crane is arranged on undercarriage 52, e.g., a crawler track assembly or several axles with tires.

Cabling is provided between the bracing boom arrangement 11 and the boom 10. The cabling comprises a first guying cable 1 that runs from guying point 50 on the bracing boom attachment 11 to the boom 10. The cabling further comprises a second guying cable 1' that is guided from a second guying point 50' on the bracing boom arrangement 11 to the boom 10. The two guying points 50 and 50' are arranged on opposite sides of the pivoting plane of the boom and are separated by a distance that is greater than the width of the boom 10. The two guying cables 1 and 1' run through here in the form of a triangle from the two guying points 50 and 50' to the boom, particularly the tip of the boom. This results in a spatial guying of the boom, through even forces diagonal to the pivoting plane can be picked up.

The bracing boom arrangement here can pivot around an axis 25 with regard to the superstructure, which runs parallel to the pivoting axis 100 of the boom. The bracing boom arrangement 11 can be pivoted without changing the distance between guying points 50 and 50'. Good lateral guying is thus guaranteed for any desired position of the bracing boom arrangement. Furthermore, the bracing boom arrangement has a cross-connection between the two guying points. This cross-connection can pick up forces that act through the guying between the two guying points 50 and 50'. The cross-connection is made available in the embodiment by the fact that the bracing boom arrangement forms a rigid structural unit that can be pivoted as a whole around the pivoting axis 25 with regard to the superstructure.

Figure 3:
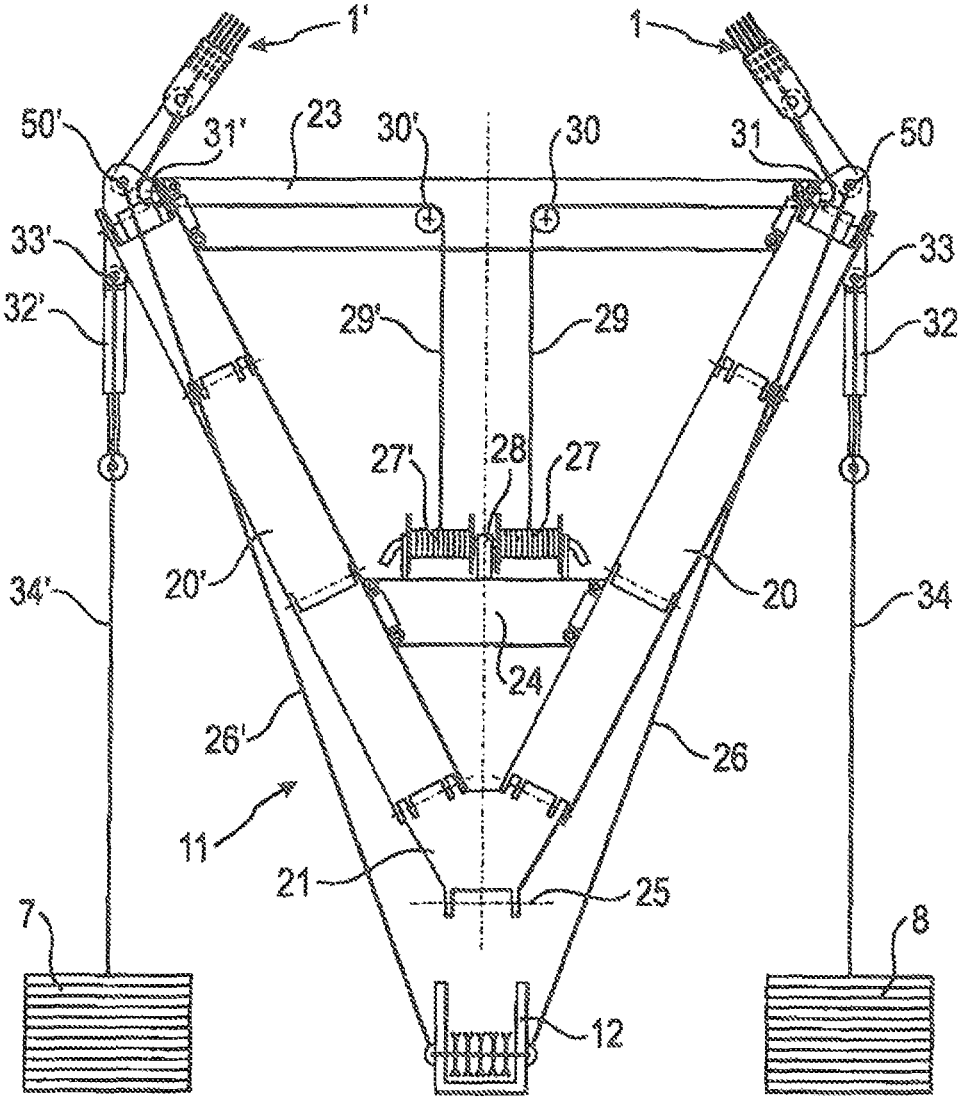
FIG. 3: The first embodiment in a rear view.

The construction of the bracing boom arrangement 11 is clarified in FIG. 3. In the embodiment, the bracing boom arrangement comprises two V-shaped boom supports 20 and 20' arranged on an articulation component 21, which supports are connected together by a cross-member 23. The bracing boom arrangement 11 thus is essentially in the shape of a triangle. The articulation component 21 is attached to the superstructure and can pivot around pivoting axis 25. The two boom supports 20 and 20' are connected together in their upper sections by means of cross-member 23. The cross-member 23 runs between the tips of the boom supports and thus perpendicular to the pivoting plane. Furthermore, a second cross-member 24 is provided that again connects the two boom supports 20 and 20' in an area between the cross-member 23 and the articulation component 21. All structural components together result in a stable, torsion-resistant triangle.

The bracing boom arrangement according to the invention has only one pivoting axis 25 by means of which the entire bracing boom arrangement can be pivoted in relation to the superstructure. The bracing boom arrangement thus permits a spatial guying of the boom due to the distance between guying points 50 and 50'. The derrick boom arrangement can consist of individual lattice units, as is clear from the drawing. The individual lattice units can be connected by means of fork and pin connections. However, none of the connecting points has a movable axis. The bracing boom arrangement thus forms a rigid structural unit.

Figure 2:
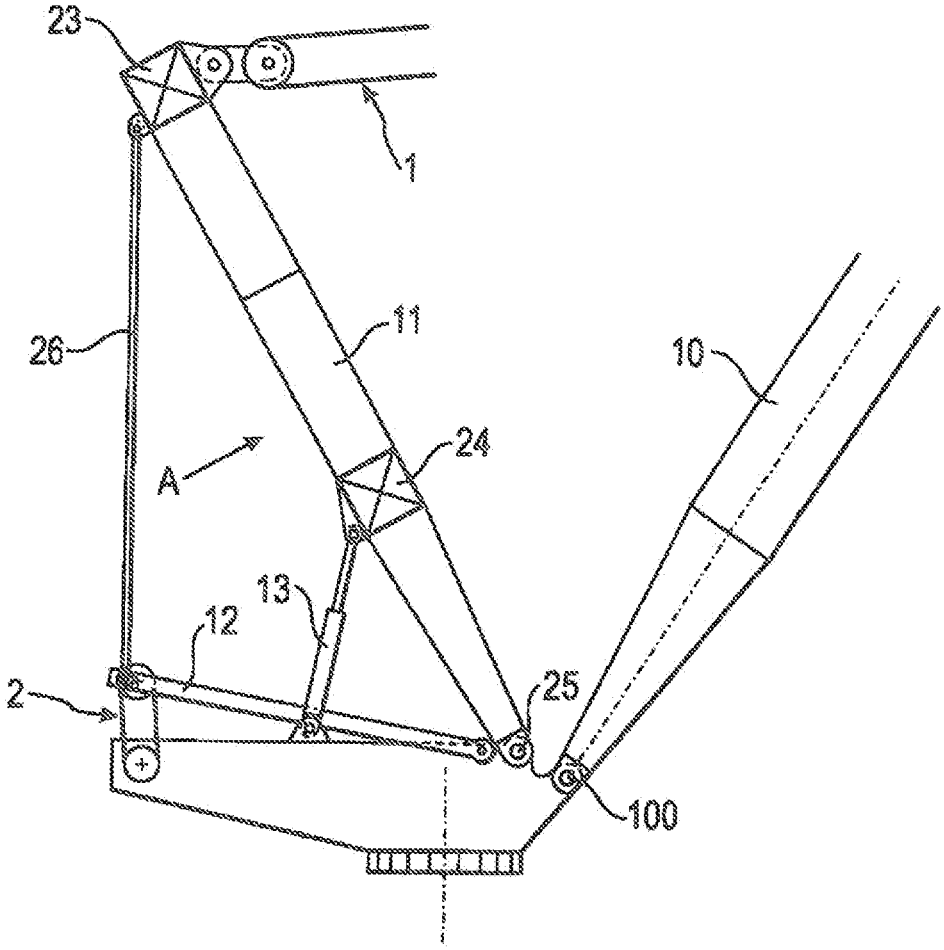
FIG. 2: The first embodiment in a side view.

As can be seen from FIGS. 1 and 2, the bracing boom arrangement can be luffed upward and downward in relation to the superstructure by means of an SA block. For this purpose, an SA support 12 is hinged to the superstructure that is connected with the bracing boom arrangement by means of tie bars 26 and 26'. The SA supports 12 can be pivoted in relation to the superstructure by means of pivoting cable 2. The tie bars 26 and 26' run from the SA support 12 arranged in the middle outward to the tips of the bracing boom arrangement. Furthermore, a stop-cylinder press 13 is provided.

The guying cables 1 and 1' between the bracing boom arrangement and the boom can change length. This involves luffing cables by which the boom can be pivoted upward and downward. In the upward and downward luffing of boom 10, the bracing boom arrangement remains unmoved so that the boom alone is luffed upward and downward by means of changing the length of guying cables 1 and 1'. If, for example, the ballast radius is changed, the bracing boom arrangement can be luffed, which occurs by means of the luffing cable 2 of the SA block 12. The controls of the crane can be designed so that the luffing cable 1 of the boom is tracked such that the boom 10 does not experience any change of angle.

To move the guying cables 1 and 1', the winches 27 and 27" are used. These winches are mounted on the bracing boom arrangement 11 and, in the embodiment, on that of lower cross-member 24. To achieve certain synchronization of the winches at need, a mechanical coupling 28 is provided. If synchronization of the winches is not necessary, the coupling 28 can also be dismounted. The cables 29 and 29' run to the guying points 50 and 50' over the return pulleys 30 or 30' and 31 or 31', which are arranged on the bracing boom arrangement. From there, the cables 29 or 29' each run to guying cable 1 or 1'. The guying cables 1 and 1' are designed as luffing cables, in which the cables 29 or 29' are guided over several return pulleys and thus form a pulley block.

Through the mechanical coupling of the two winches 27 and 27', they are run, at least theoretically, evenly by the winches. Of course, discrepancies can arise when changing position or in case of unreeling errors. Since the two cables 29 and 29' form the luffing cable, such cases must be excluded. Otherwise the boom 10 would experience a one-sided load from the luffing cable and could be drawn out of the pivoting plane. The spatial guying of the boom and thus the maintenance of the boom 10 in the pivoting plane is, however, precisely the task of the spatial luffing cable according to the invention.

Therefore, one measurement system each is provided in the path of cables 29 and 29' for the detection of the length of the cables. The cable length detection in the embodiment takes place by means of metering rollers 30 and 30' which are arranged in the paths of cables 29 and 29'. The type and position of the cable length detector is irrelevant here. What is important is only that the cable length detector measure the length of cable actually reeled off.

The cable length detector determines the length of cables 29 and 29' respectively reeled off and reports the value to the controls. At the start of crane operation, when the main mast 10 is in the pivoting plane, the cable length detector can be zeroed out. After that point, the controls follow the length of cables 29 and 29'. In case of impermissible discrepancies, the crane controls issue a warning. Alternatively or additionally, provision can also be made so that the crane controls can intervene in the crane drives. In particular, the crane controls can stop the crane drives.

As is also shown in FIG. 3, the two luffing cables 1 and 1' are also mounted on the guying points 50 and 50' by means of cardan joints. The angles between the main mast 10 and the bracing boom arrangement change constantly during crane operation when the luffing cable is actuated. The cardan joint articulation thus permits tracking of the lulling cable. The cardan joint attachment permits movement of the pulleys, through which the lulling cable runs, around two axes perpendicular to each other.

Furthermore, each of the two guying cables 1 and 1' are assigned a force measuring device. This is arranged, in the embodiment, between the guying points and the pulleys for the luffing cable and permits detection of the forces in both guying cables 1 and 1'. These measured values are also sent to the controls, according to the invention.

One advantage of the spatial guying according to the invention is shown in particular in FIG. 1. In comparison to booms without spatial guying, the forces are introduced into the superstructure perpendicular to the pivoting plane of the boom by means of two axes. Without such spatial guying, the bracing boom could not support the main mast perpendicular to the pivoting plane. In this case, the pivoting axis of the boom would transmit all forces from the resultant torque from the boom to the superstructure. In contrast to this, the bracing boom arrangement in the within invention supports the main mast even against forces that act perpendicularly to the pivoting plane. They are thus transmitted via pivoting axis 25 of the bracing boom arrangement to the superstructure.

FIG. 3 also shows how the bracing boom arrangement according to the invention is used as a derrick boom. Here, two separate derrick ballast components 7 and 8 are provided that are attached to two separated attachment points 33 and 33' on the bracing boom arrangement 11. The attachment point 33 is located in the area of guying point 50, while the attachment point 33' is located in the area of the second guying point 50'. The distance between the attachment points 33 and 33' thus corresponds essentially to the distance between the guying points 50 and 50'.

The lateral arrangement of the derrick ballast components on the bracing boom arrangement thus has the advantage, for one thing, that the derrick boom arrangement 11 thus has a substantially increased lateral stability, through which forces acting even perpendicular to the pivoting plane of the boom can be picked up and counterbalanced. Another advantage of the two separated derrick ballast components 7 and 8 is explained in greater detail now based on FIG. 4.

The first derrick ballast component 8 is attached at attachment point 33 by means of connection 34, whereby said component is located directly under the attachment point 33, outside the support surface of the crane during crane operation. In the same way, a second derrick ballast component 7 is attached to attachment point 33' by means of attachment 34', which component is also located under attachment point 33' outside the support surface of the crane during crane operation.

The distance between the attachment points 33 and 33' here is large enough that the attachment ballast components 7 and 8 are located next to the undercarriage 52 and outside the slew circle of the support base 51 of the crane. The support base, in FIG. 4, has the dimensions of the undercarriage and the crawler travel gear, on which the crane is supported on the ground. The crane can thus travel or the superstructure with the attached ballast components 7 and 8 can be slewed Here, the distance between the two attachment points 33 and 33' is advantageously larger than the width B of the support base plus the corresponding dimensions of the ballast components 7 and 8, and further advantageously, larger than the diagonal dimension D of the support base plus the corresponding dimensions of the derrick ballast components.

As is usual with derrick booms, the derrick ballast is attached to the derrick boom arrangement on the side of the boom opposite the slew axis 3 of the superstructure so that it exerts torque on the crane which counters the torque exerted by the load on the crane by means of the boom 10. The connecting line between the attachment points 33 and 33', on which the common center of gravity of the two derrick ballast components lies, is thus arranged behind the slew axis 3 of the superstructure. According to the invention, the distance between the connecting line and the slew axis 3 can be changed by luffing the bracing boom arrangement in order to be able to change the mechanical advantage produced by the derrick boom.

Figure 4:
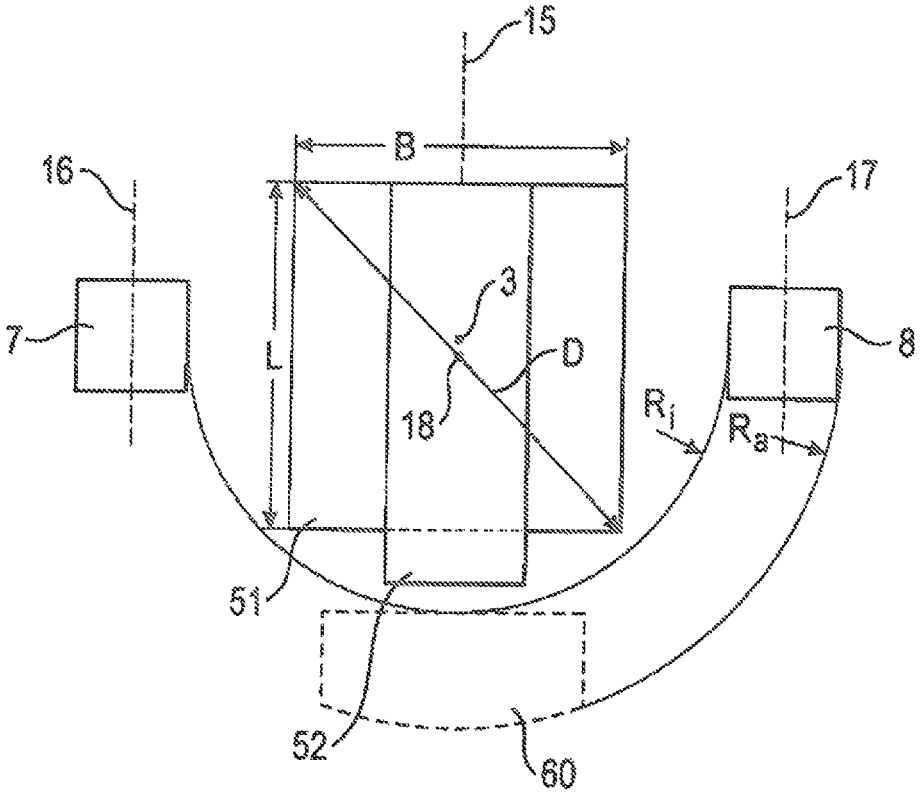
FIG. 4: The embodiment of the within invention in a top view to explain the derrick-crane operation.
Figure 5:
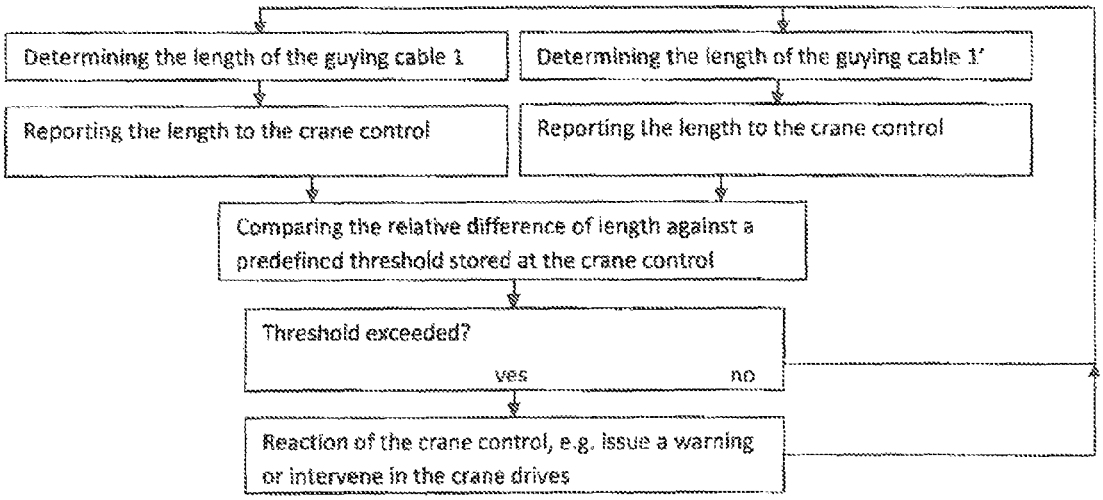
FIG. 5: A schematic illustration of the crane control in accordance with the invention.

As can be seen from FIG. 4, the attachments points for the ballast components 7 and 8 move along planes 16 and 17 during the pivoting of the bracing boom arrangement, which planes run parallel to the pivoting 15 of the boom 10. Due to the lateral arrangement of the two ballast components, they can be moved from a front position in which the connecting line between the two attachment points 33 and 33' is arranged near the slew axis 3 of the superstructure, into a rear position in which there is a larger mechanical advantage. The derrick ballast components 7 and 8 are located outside the slew circle of the support base of the crane over its entire travel, so that the slewability of the superstructure is guaranteed.

As is shown in FIG. 4 by the dotted line, the advantage over a conventional derrick ballast component is obvious: The superstructure there can be stewed only in one position in which the ballast component 60 is at a great distance from slew axis 3, resulting in a larger mechanical advantage. Through the within invention, on the other hand, the mechanical advantage of the derrick boom arrangement can be adjusted freely without limiting the slewability of the superstructure.

The distance between the ballast and the attachment can be changed by means of power hoists. With the slewing of the superstructure with hanging derrick ballast components it is advantageous to hoist the derrick ballast components only a very little off of the ground. This immediately results in support by the ground if, for example, the load breaks loose. This prevents a dangerous backward tipping of the crane. Through the use, according to the invention, of two derrick ballast components, however, it is possible to slew the superstructure through 360° since they can be arranged outside the support base of the crane or the slew radius of the undercarriage.

In operation, each derrick boom is positioned by the derrick ballast by guying (the usual backfall security is present). The force in links 34 and 34' between the attachment points to the derrick booms and the respective ballast components is thus measured and sent to the controls. If the difference between the forces measured in the links exceeds a defined limit value, for example by 10%, a warning is issued or the movement is stopped.

The boom can be luffed upward or downward by luffing cable 1. If a large load is picked up by the boom, the derrick ballast can be lifted from the ground. There is a counterbalance between the load torque and the ballast torque, whereby the center of gravity lies within the length of the support base L of the crane. The crane can travel in this state. The size of the ballast torque can be changed by means of the position of the attachment points by lulling the derrick ballast arrangement. Here, the lever action of the derrick boom can be adjusted by means of the distance of the connecting line between the two attachment points and the slew axis of the superstructure.

If the crane is now intended to travel or slew without a load but with the ballast weights attached, the derrick boom arrangement can be pivoted forward with the derrick ballast components. Here, the overall center of gravity shifts until it finally lies within the support surface of the crane. Since the entire system is built symmetrically from derrick booms and ballast components, the overall center of gravity 18 always lies on the axis of the superstructure. Alternatively, of course, the crane could travel until the ballast stack has reached the desired position and can then be picked up by the derrick booms.

The slew radius of the crane or the superstructure is not enlarged by the pivoting of the derrick boom arrangement. The two ballast components 7 and 8 can be arranged as close as possible to the center of the slew so that the inner slew radii Ri of the two ballast components are only slightly larger than the diagonal dimension D of the crawler. The outside slew radius Ra of the ballast components for such positions, in which the boom is luffed upward and the lever of the derrick boom is thus small, is kept small by this means. The necessary operating space for the crane is thus not enlarged unnecessarily. Only when the derrick boom travels further backward, to enlarge the lever arm and to pick up a load, is the radius Ra enlarged and the space required expanded.

The expanded space required, however, is offset by the good lateral stability of the boom since even with large movements of the derrick boom arrangement, with the corresponding large lever action, good lateral bracing is guaranteed through the separated attachment points for the derrick ballast components and the separated guying points of the luffing cable.

The within invention thus facilitates both a flexible and stable guying of the boom through the use of two separated derrick ballast components with separated attachment points as well as the good travel and slew of the crane, particularly even without a load attached to the crane. Thus, the two ballast components are no longer arranged in the pivoting plane, as in the current art, but rather are at a certain distance from the pivoting plane of the boom to the side of the crane. The lever action of the derrick boom arrangement can be changed hereby by moving the derrick ballast components forward or backward on the side near the support base of the crane.

The bracing boom arrangement according to the invention further facilitates good spatial guying of the boom with two guying points guided from the guying cables to the boom. The good spatial guying thus remains independent of the angle of slew of the bracing boom arrangement due to the slew axis of the bracing boom arrangement arranged parallel to the slew axis of the boom. The cross-connection between the two guying points or the two attachment points picks up the forces occurring during guying and thus permits a substantially more stable design of the bracing boom arrangement. In addition, this takes care of the synchronization of the guying points during luffing of the bracing boom arrangement.

According to the invention, the within invention can be used particularly advantageously in traveling cranes, particularly crawler cranes. Its use on mobile cranes can also be considered.

What is claimed is:

1. A crane having a superstructure, a boom (10) directly hinged to the superstructure about a pivot axis (100) in a luffable manner in a vertical pivoting plane (15), a bracing boom arrangement (11) directly hinged to the superstructure about a separate pivot axis (25), and cabling running between the boom (10) and the bracing boom arrangement (1) and arranged to lull the boom (10), wherein the cabling has at least two guying cables (1, 1') running to the boom (10) over two guying points (50, 50') of the bracing boom arrangement (11) on opposite sides of the pivoting plane (15), the bracing boom arrangement (11) is pivotable around the separate pivot axis (25) standing perpendicular to the pivoting plane (15) of the boom (10) and has a rigid cross-connection (23) between the two guying points (50, 50'), the bracing boom arrangement (11) comprises first and second booty supports (20, 20') arranged in combination with the cross-connection (23) to provide a V-shaped structure on an articulation component (21) forming an apex at one end thereof and with the rigid cross-connection (23) spaced away from the articulation component (21) and extending perpendicular to the pivoting plane (15), such that the bracing boom arrangement (11) has a triangular structure defined by the boom supports (20, 20') and the rigid cross-connection (23) forming bases of such triangular structure, and the at least two guying cables (1, 1') are mounted to the bracing boom arrangement (11) at the two guying points (50, 50'), by return pulleys (30, 30'; 31, 31') hinged to the bracing boom arrangement (11) in a rotatable manner around two axes.

2. The crane of claim 1, wherein the at least two guying cables are each movable around a respective one of two winches and a mechanical coupling between the two winches is provided by which the movement of the two winches can be force coupled.

3. The crane of claim 1, wherein at least two separated derrick ballast components are attached to at least two separated attachment points.

4. The crane of claim herein the bracing boom arrangement is pivotally mounted in relation to the superstructure.

5. The crane of claim 1, wherein the boom and/or the bracing boom arrangement is constructed of lattice units.

6. The crane of claim 1, wherein the rigid cross-connection (23) extends from a tip of the first boom support to a tip of the second boom support.

7. The crane of claim 1, wherein the bracing boom arrangement (11) forms a rigid structural unit that is hinged to the separate pivot axis (25) on the superstructure, the separate pivot axis (25) standing perpendicular to the pivoting plane (15) of the boom (10).

8. The crane of claim 7, wherein one or more winch(es) is/are arranged to move the guying cables on the bracing boom arrangement.

9. The crane of claim 1, wherein the crane has a cable length detector to detect and monitor the length of the at least two guying cables.

10. The crane of claim 9, wherein crane controls and/or the cable length detector comprise(s) a zero-point function by which the deviation between the cable lengths can be set to zero at the start of operation of the crane.

11. The crane of claim 9, wherein the cable length detector has a measurement system that measures the actual cable length unreeled from winches.

12. The crane of claim 9, additionally comprising crane controls arranged to equalize the length of the at least two guying cables based on the data from the cable length detector and, in the case of an impermissible discrepancy, trigger a reaction.

13. The crane of claim 12, wherein the crane controls issue a warning and/or intervene in control of drives.

14. A process for the operation of a crane, the process comprising:

providing the crane of claim 1, and wherein the boom is luffed in the pivoting plane by a cable.

15. The process for operation of a crane of claim 14, wherein a deviation between the cable lengths of the at least two guying cables at the start of operation of the crane is set to zero.

16. A having a superstructure, a boom (10) directly hinged to the superstructure about a pivot axis (100) in a luffable manner in a vertical pivoting plane ( 15), a bracing boom arrangement (11) directly hinged to the superstructure about a separate pivot axis (25), and cabling running between the boom (10) and the bracing boom arrangement (11) and arranged to luff the boom (10), wherein the cabling has at least two guying cables (1, 1') running to the boom (10) over two guying points (50, 50') of the bracing boom arrangement (11) on opposite sides of the pivoting plane (15), the bracing boom arrangement (11) is pivotable around the separate pivot axis (25) standing perpendicular to the pivoting plane (15) of the boom (10) and has a rigid cross-connection (23) between the two guying points (50,50')

the bracin boom arrangement (11) compises first and second boom supports (20, 20') arranged in combination with the cross-connection (23) to provide a V-shaped structure on an articulation component (21) forming an apex at one end thereof and with the rigid cross-connection (23) spaced away from the articulation component (21) and extending perpendicular to the pivoting plane (15), such that the bracing boom arrangement (11) has a triangular structure defined by the boom supports (20, 20') and the rigid cross-connection (23) forming bases of such triangular structure, the at least two guying cables (1, 1') are mounted to the bracing boom arrangement (11) at the two guying points (50, 50'), by return pulleys (30, 30'; 31, 31') hinged to the bracing boom arrangement (11)in a rotable manner around two axes, and one or more winch(es) is/are arranged to move the at least two guying cables on the bracing boom arrangement.

17. A crane having a superstructure, a boom (10) directly hinged to the superstructure about a pivot axis (100) in a luff able manner in a vertical pivoting plane (15), a bracing boom arrangement(11) directly hinged to the superstructure about a separate pivot axis (25), and cabling running between the boom (10) and the bracing boom arrangement (11) and arranged to luff the boom (10), wherein the cabling has at least two guying cables (1, 1') running to the boom (10) over two guying points (50, 50') of the bracing boom arrangement (11) on opposite sides of the pivoting plane (15), the bracing boom arrangement (11) is pivotable around the separate pivot axis (25) standing perpendicular to the pivoting plane (15) of the boom (10) and has a rigid cross-connection (23) between the two guying points 50,50'), the bracing boom arrangement (11) comprises first and second boom supports (20, 20') arranged in combination with the cross-connection (23) to provide a V-shaped structure on an articulation component (21) forming an apex at one end thereof and with the rigid cross-connection (23) spaced away from the articulation component (21) and extending perpendicular to the pivoting plane (15), such that the bracing boom arrangement (11) has a triangular structure defined by the boom supports (20, 20') and the rigid cross-connection (23) forming bases of such triangular structure, the at least two guying cables (1, 1') are mounted to the bracing boom arrangement 11 at the guying two L in points(50,50'), by return pulleys (30, 30';31, 31') hinged to the bracing boom arrangement (11) in a rotatable manner around two axes, the rigid cross-connection (23) extends from a tip of the first boom support to a tip of the second boom support, and further containing a second cross-connection (24) which connects the first and second boom supports in an area between the first cross-connection (23) and the articulation component (21).

18. The crane of claim 17, wherein the at least two guying cables are each movable around a respective one of two winches and a mechanical coupling between the two winches is provided by which the movement of the two winches can be force coupled, and wherein the winches are mounted to the second cross-connection (24).

19. The crane of claim 17, additionally comprising a stop cylinder (13) pivotally interconnecting the second cross-connection (24) and the superstructure, an SA support (12) hinged to the superstructure, and tie bars (26, 26') interconnecting the SA support (12) with the respective guying points (50, 50') of the bracing boom arrangement (11).

20. The crane of claim 19, additionally comprising winches (27, 27') mounted on the second rigid cross-connection (24), a mechanical coupling (28) between said winches (27, 27') and mounted on the second cross-connection (24), and return pulleys (30, 30', 31, 31') mounted upon the first cross-connection (23), with each said guying cable (1, 1') wrapping around a respective winch (27, 27') and running to the respective guying points (50, 50') over respective return pulleys (30, 30', 31, 31').

21. The crane of claim 20, additionally comprising attachment points (33, 33') for derrick ballast components (7,8) each located in a area of one of the a respective guying points (50, 50'), and attachments (34) for a respective derrick ballast component (7,8) coupled to and extending underneath a respective attachment point (33, 33'), such that the derrick ballast components (7,8) are located outside a slew circle of a support base (51) for the crane.

* * * * *